US008523703B2

(12) United States Patent
Rife

(10) Patent No.: US 8,523,703 B2
(45) Date of Patent: Sep. 3, 2013

(54) PUTTER TYPE GOLF CLUB HEAD WITH IMPROVED BALL STRIKING FACE CONFIGURATION

(75) Inventor: Guerin Rife, Carlsbad, CA (US)

(73) Assignee: Guerin Design Putter Co, LLC, Carlsbad, CA (US)

( * ) Notice: Subject to any disclaimer, the term of this patent is extended or adjusted under 35 U.S.C. 154(b) by 100 days.

(21) Appl. No.: 13/199,144

(22) Filed: Aug. 22, 2011

(65) Prior Publication Data

US 2013/0053170 A1 Feb. 28, 2013

(51) Int. Cl.
*A63B 53/04* (2006.01)

(52) U.S. Cl.
USPC ..... 473/330; 473/331; 473/340

(58) Field of Classification Search
USPC ..... 473/330, 331, 340, 341; D21/736–746, D21/750
See application file for complete search history.

(56) References Cited

U.S. PATENT DOCUMENTS

| | | | | | |
|---|---|---|---|---|---|
| 1,289,553 | A * | 12/1918 | Sanders | 473/331 |
| 1,337,958 | A * | 4/1920 | Reach | 473/331 |
| 1,536,616 | A * | 5/1925 | Manning | 473/331 |
| 1,965,954 | A * | 7/1934 | Davis | 473/242 |
| 2,005,401 | A * | 6/1935 | Storz | 473/331 |
| D122,795 | S * | 10/1940 | Geerlings | D21/750 |
| D148,193 | S * | 12/1947 | Smith | D21/750 |
| 3,869,126 | A * | 3/1975 | Thompson | 473/331 |
| 4,413,825 | A * | 11/1983 | Sasse | 473/331 |
| 4,508,349 | A * | 4/1985 | Gebauer et al. | 473/330 |
| 4,964,641 | A * | 10/1990 | Miesch et al. | 473/330 |
| 5,354,059 | A * | 10/1994 | Stuff | 473/329 |
| 5,618,239 | A * | 4/1997 | Rife | 473/330 |
| 5,637,044 | A * | 6/1997 | Swash | 473/331 |
| 5,688,186 | A * | 11/1997 | Michaels et al. | 473/290 |
| 5,688,190 | A * | 11/1997 | Rowland et al. | 473/330 |
| 5,709,616 | A * | 1/1998 | Rife | 473/330 |
| 5,785,610 | A * | 7/1998 | Birmingham | 473/331 |
| D398,357 | S * | 9/1998 | De La Cruz et al. | D21/750 |
| 6,110,057 | A * | 8/2000 | McKinnon | 473/313 |
| 6,183,379 | B1 * | 2/2001 | Kim et al. | 473/325 |
| 6,257,994 | B1 * | 7/2001 | Antonious | 473/331 |
| 6,849,004 | B2 * | 2/2005 | Lindsay | 473/330 |
| 7,056,226 | B2 * | 6/2006 | Kennedy | 473/330 |
| 8,337,324 | B2 * | 12/2012 | Sander et al. | 473/330 |

* cited by examiner

*Primary Examiner* — Sebastiano Passaniti
(74) *Attorney, Agent, or Firm* — Nicholas J. Aquilino

(57) ABSTRACT

A putter type golf club head having a unique ball striking face configuration to eliminate the dimple effect of grooved putters formed with a series of grooves and intermediate land areas between the grooves extending in a longitudinal direction across the striking face. Each of the grooves is characterized by a plurality of repeating, non-linear wave forms located at the center of the striking face and extending outwardly therefrom.

10 Claims, 2 Drawing Sheets

PUTTER TYPE GOLF CLUB HEAD WITH IMPROVED BALL STRIKING FACE CONFIGURATION

BACKGROUND

The present invention relates to putter type golf club heads and in particular to an improved ball striking face groove configuration for use with putters.

Golf balls are made with a variety of dimple patterns in order to improve the aerodynamic flight characteristics of the ball that has been struck by a golf club with a full golf swing. The dimples create an aerodynamic surface thereby allowing the ball to achieve lift and thus travel longer and with more accuracy than if the balls were made with a smooth surface. The irregular surface created by the dimples has little effect on full swing shots because of the compression of the golf ball. Little consideration has been given to the way a golf ball reacts when the ball is hit softly, as when stuck by a putter. However these shots that are hit softly with little compression are subject to what is known in the industry as the "dimple effect". Briefly described, the dimple effect is the tendency of a golf ball to start off the intended target line when the ball is struck by the putter face at the edge of a dimple. The inward concave shape of a dimple acts as a flat surface running from one edge of the dimple to the other. As the flat, hard ball striking surface of a putter comes in contact with the edge of a dimple, the other side of the dimple will cause the ball to slightly rotate as the dimple tries to square itself with the flat putter surface. This starts the ball slightly off line. This inaccuracy is magnified as the length of the putt increases. The larger the dimples, the more pronounced the error tends to be with all other parameters of the stroke being equal. While grooved putter faces have improved the quality of roll by reducing skid, the dimple effect is still present and effects accuracy as described above.

The advantages of the grooves on the ball striking face of a putter outweigh the disadvantages of the dimple effect. Typically golf putters incorporate a smooth, flat non-grooved ball striking face. Flat face putters provide a maximum face surface to present to the irregular surface of the golf ball. Most of these putters have four to six degrees of loft, it being common wisdom this amount of loft is necessary to cleanly launch a golf ball on top of the irregular surface of a putting green. Sometimes it is no more than the weight of the ball that causes a slight depression in the green's surface directly under the ball as the golfer walks from the place where the shot to the green was hit to the location on the green where the ball is at rest. This lofted design causes the golf ball to be launched slightly above the green's surface with a slight back spin. In turn, the golf ball initially skips and skids before fully engaging the green surface and beginning to roll. This further led to the development of putters with closely spaced grooves on the ball striking face that created lift without loft to get the golf ball out of its depression and rolling almost immediately with little or no skid.

Examples of these grooved face putters include Applicant's own patents, U.S. Pat. No. 5,168,239 titled Groove Configuration for a Golf Club and U.S. Pat. No. 5,709,616 titled Groove Configuration for a Putter Type Golf Club Head. Both the patents teach the use of closely spaced, straight, horizontal grooves each with a slightly different groove configuration. U.S. Pat. No. 5,168,239 teaches the use of asymmetrical saw-toothed shaped grooves. U.S. Pat. No. 5,709,616 teaches the use of symmetrical grooves wherein the land areas between the grooves is smaller than the groove spacing.

Both of these groove technologies grip and lift a golf ball at impact by the putter face. However, because this groove configuration is straight in a heel to toe, or horizontal direction when the putter is properly soled relative to the green's surface, impacts on the edge of a dimple cause the ball to start slightly off line.

Other attempts at providing a ball striking face configuration for more accurate golf ball roll is shown in U.S. Pat. No. 5,637,044 to Swash that uses a plurality of equally spaced concentric, arcuate grooves surrounding the center of the ball striking face of the putter. The arcuate configuration promotes the possibility of the ball going further off line when the ball is struck off center on a downward portion of the arcuate groove pattern or when a golfer swings the putter head in a diagonal stroke path.

The patent to Reach U.S. Pat. No. 1,337,958 teaches the use of grooves on a wedge type golf club wherein the grooves are configured in a set of curves diagonally across the face from the lower toe to the upper heel. The grooves are formed in a single wave pattern, having a single upward and a single downward configuration. In the preferred embodiment the grooves are substantially wider than conventional grooves with the groove spacing being approximately the same size as the land area. As is customary when using a wedge, the face can be laid open to create greater amounts of loft in order to hit the ball higher in the air. When the club face is used in a laid open position, the ball travels from the lower heel to the upper toe in diagonal direction across the face of the wedge. Unlike conventional wedges with straight horizontal grooves that can only grip the ball at a diagonal when the face is laid open, producing less backspin, the Reach curved singular wave groove pattern is designed to be perpendicular to the path of the ball regardless of how much the golfer lays the face open, producing both higher ball flight and more backspin.

Other putter face configurations to control the golf ball struck by the putter include the use of dimples and raised protuberances on the face of the putter. In addition a wide variety of lines, geometrical designs and decorative patterns on the face of a putter have been used in an attempt to improve the contact between the putter face and the golf ball at impact during the execution of a putting stroke. For example, U.S. Pat. No. 6,257,994 to Antonious discloses a variety of grooved lines as well as geometrical patterns on the face of a putter.

SUMMARY OF THE INVENTION

The present invention is an improvement over all other groove technologies by improving the putter face to ball contact using a groove configuration that better conforms to the irregular dimpled surface of a golf ball.

In accordance with the present invention the putter face groove configuration is preferably formed in a closely spaced and repetitious undulating, sinusoidal wave pattern located horizontally across the ball striking face, in a heel to toe direction. The wave pattern of the present invention is formed having sufficiently small undulating wavy grooves that more easily interact with the inherently uneven dimple pattern on the surface of a standard golf ball. Because the wavy groove configuration is not straight across the putter face, as with most linear groove patterns, the undulating pattern of the waves presents more groove and land area to the surface to the ball greatly reducing the dimple effect.

In a preferred embodiment, grooves are formed one over another between the top surface of the putter head and the bottom leading edge and each of the grooves is spaced the same distance from another immediate adjacent groove such that the width of the groove is preferably wider than the land area separating the grooves. Because the pattern of waves is undulating, an increased land area is presented to and conforms to the dimple pattern of the golf ball when struck by a putter with the groove technology of the present invention than with a straight or linear groove configuration.

It will be appreciated that the groove pattern is equally applicable to a variety of putter head configurations such as blade or mallet type putters. The grooves may extend totally across the face of the putter or they may be centrally located on the face where the majority of impacts with a golf ball are made. Preferably the series of grooves are located from adjacent the bottom leading edge to the top surface of the putter head.

With a standard size putter head approximately 10 to 12 grooves are typically formed between the top surface and bottom leading edge of the putter face. Each groove typically has between six and 10 wavy undulations across the face of the putter. Referring to the drawings it can be seen that a preferred embodiment of a putter head of the invention uses grooves extend upwardly approximately the same distance as the grooves extend downwardly forming a repeating sinusoidal configuration across the face.

The grooves do not necessarily have to be equally spaced or parallel to each other to provide the advantages of the present groove configuration. Nor do they have to be continuous or rounded. The grooves may be discontinuous, that is they may have small breaks between the dimple conforming shapes as shown in the alternate embodiments described hereinbelow Other embodiments include a putter striking face where the groove pattern is repeating in a variety of different configurations, including arcs, chevrons, trapezoids, non-symmetrical waves, continuous and non-continuous waves as described in detail hereinbelow.

Among the objects of the present invention is the provision of a putter type golf club head having a groove configuration that creates an improved roll when impacting a golf ball.

Another object is the provision of a putter face groove configuration that prevents a golf ball from sliding sideways on off-center hits.

Another object is the provision of a putter face groove configuration that has all the advantages of grooves while reducing the dimple effect.

A still further object is the provision of a putter face groove configuration having an undulating, wavy pattern designed to interact favorably with the dimple pattern of a golf ball.

These and other objects will become apparent with reference to the following specification and accompanying drawings.

DESCRIPTION OF THE PREFERRED EMBODIMENTS

Figure 1:
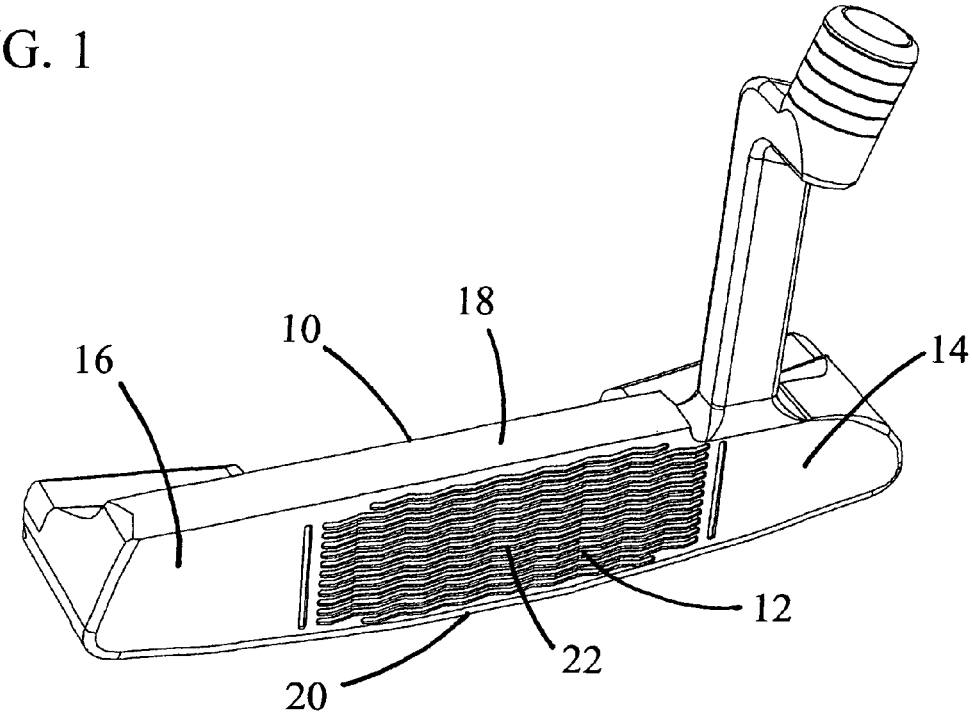
FIG. 1 is a front perspective view of a putter type golf club with a groove configuration in accordance with the present invention.
Figure 2:
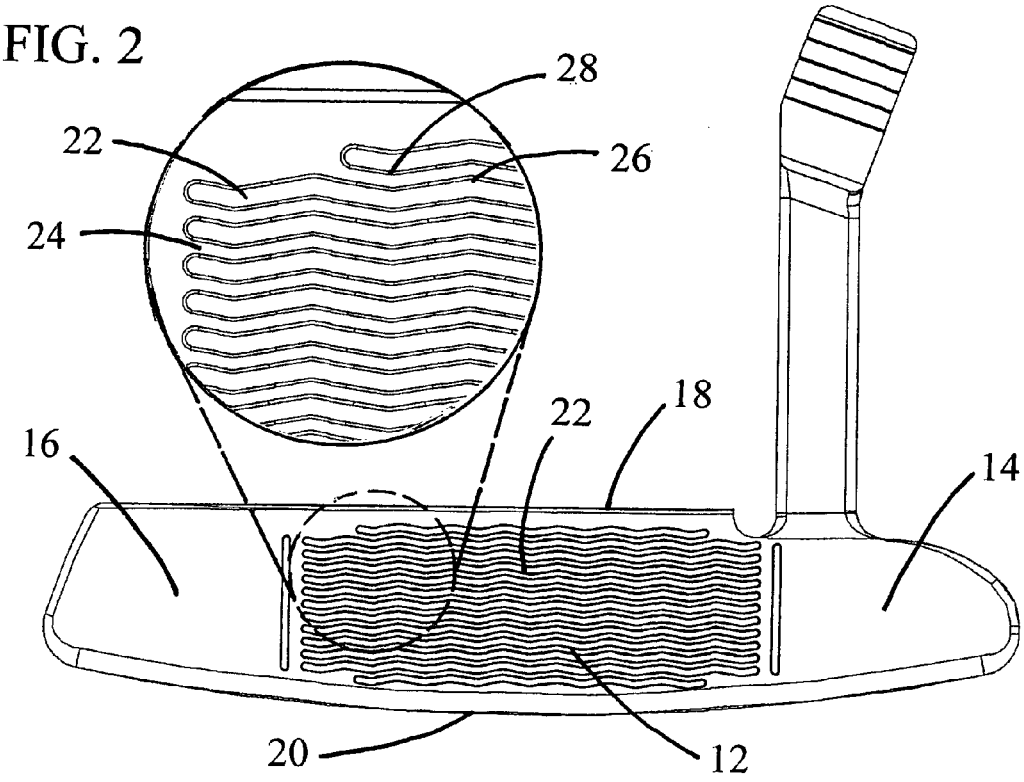
FIG. 2 is a front elevational view of the putter head of FIG. 1 with a magnified representation of the groove configuration in accordance with the present invention.

Referring to the drawings, a putter type golf club head 10 is shown as a typical heel-toe weighted putter with a ball striking face 12, heel 14, toe 16, top surface 18 and bottom leading edge 20. A center portion of the face 12 is provided with a series of grooves 22 formed of an undulating wavy pattern extending in a longitudinal; heel to toe direction across the ball striking face 12. The wavy pattern creates a series of waveforms generally sinusoidal in shape, characterized by the length of each repetition of the waveform to be the same as the adjoining repetition and the frequency of the wave pattern being consistent along the entire length of the grooves 22. As seen, a land area 24 between the grooves 22 is smaller than the width of the groove 22 presenting a smaller surface to contact the ball upon impact. This structure allows the putter face to grip and lift the back side of the ball causing it to immediately start rolling with a minimum of skid or slide. The wavy undulations of the grooves 22 presents more land area and accompanying groove area to the golf ball than straight grooves without having to increase the width of the land area 24. Said in another way, the wavy groove pattern presents more surface area to contact the dimple pattern of a golf ball than would be presented by straight grooves because there is more groove per given length of putter face.

The wavy configuration of the grooves 22 forms an uppermost groove edge 26 and a lowermost groove edge 28. In the present embodiment, the uppermost groove edge 26 of each groove 22 extends upwardly the same distance as the lowermost groove edge 28 extends downwardly when viewing the grooves 22 disposed horizontally in a normal set up position just prior to the execution of a putting stroke. In other words the grooves 22 are symmetrical between the upper surface 18 and the lower leading edge 20 of the putter head 10.

In the embodiment shown there are eleven grooves 22 stacked on the face of the putter 10, generally equally spaced from each other between the top surface 18 and bottom leading edge 20 of the putter 10. The longer grooves 22 have a pattern of eight repetitions of the wave form across the face of the putter 10. The number of grooves 22 insures that the golf ball is struck with at least a portion of the overall groove pattern even if the strike is displaced from the center of the face 12.

Figure 3:
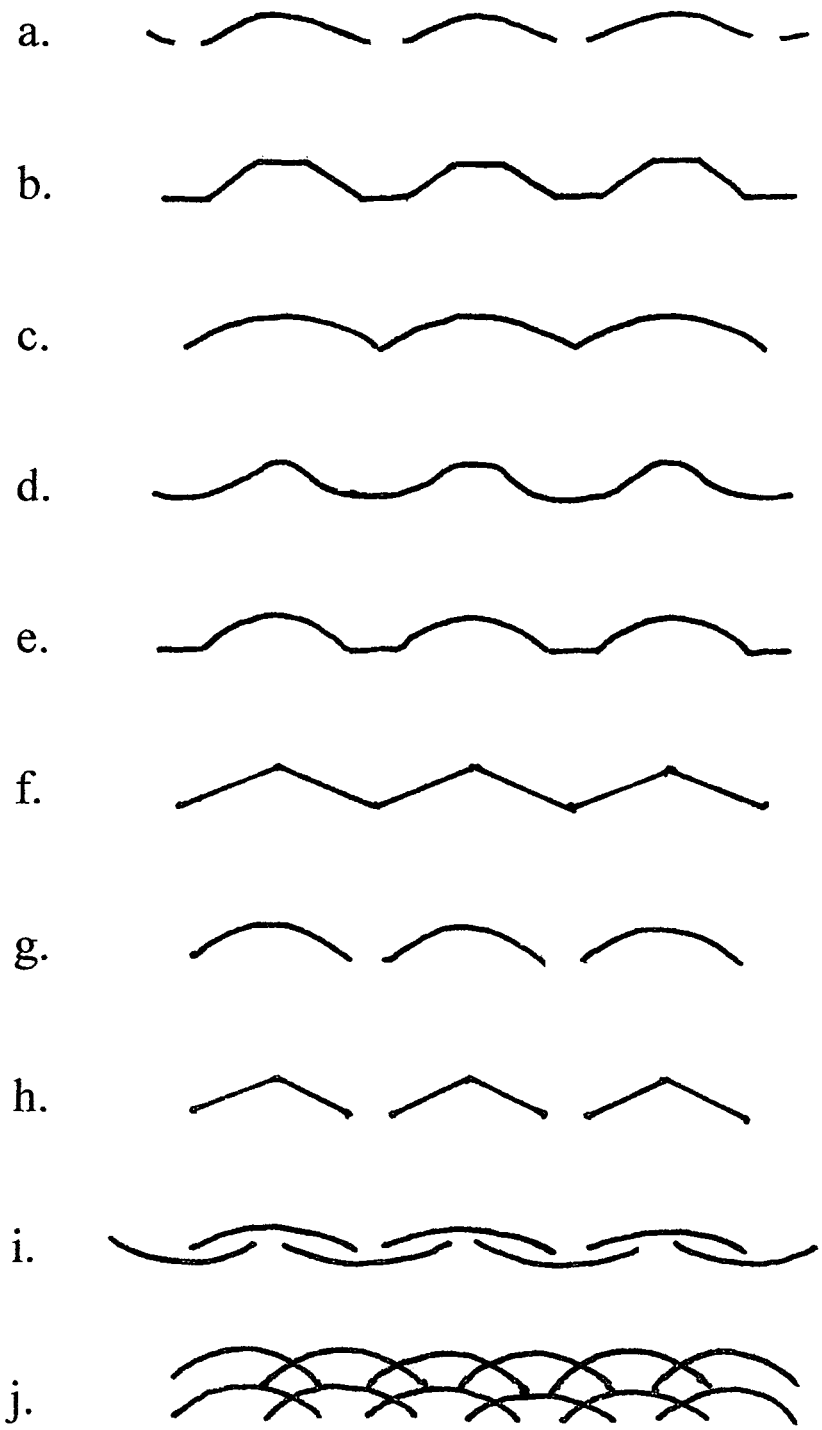
FIG. 3 is a view of alternate embodiments of groove configurations in accordance with the present invention.

FIGS. 3*a* to 3*j* discloses a number of alternate embodiments of groove configurations in accordance with the present invention. FIG. 3*a* is a wavy groove that has discontinuity along the length of the groove. FIG. 3*b* is a groove configuration with a series of trapezoidal shaped sections. FIG. 3*c* is a groove configuration of a series of connected arcs. FIG. 3*d* is a wavy groove having non-symmetrical waves. FIG. 3*e* is a groove configuration of spaced arcs. FIG. 3*f* is a groove configuration of a series of connected chevrons. FIG. 3*g* is a groove configuration of a series of disconnected arcs. FIG. 3*h* is a groove configuration of a series of disconnected chevrons FIG. 3*i* is a groove configuration of a series of individual grooves of alternately disposed upwardly and downwardly facing arcs. FIG. 3*j* is a groove configuration of a series of overlapping and interconnected arcs.

It will be appreciated that the above groove configurations are exemplary only and that other variations are contemplated. For example almost any non-linear, repeating groove configuration will expose more of the groove to the dimpled golf ball than a linear groove configuration. In addition, the length of the grooves may vary between the heel and toe of the putter face and the height of the wavy pattern between the top and bottom of the putter face may vary to change the groove effect on a golf ball. These and other modifications may be made in the present invention in keeping within the spirit and scope of the following claims.

The invention claimed is:

1. A putter type golf club head comprising a frontal ball striking face, top surface, bottom leading edge, heel, toe, rear surface and shaft connection; said frontal ball striking face characterized by a plurality of closely spaced grooves formed as repeating, non-linear waveforms; said grooves centrally located on said striking face and extending in a longitudinal direction between said toe and said heel; said frontal ball striking face further includes land areas between said grooves extending in a longitudinal direction across said striking face; said grooves being wider than the land areas separating the grooves.

2. The putter type golf club head of claim 1 wherein said grooves are further characterized as being undulating in a repeating upwardly and downwardly wave form configuration across said face.

3. The putter type golf club head of claim 2 wherein each of said grooves is formed with repeating wave form configurations on said putter face and wherein said grooves are arrange in a stack one over another between said top surface and said bottom leading edge of said putter.

4. The club head of claim 2 wherein said grooves are sinusoidal in shape and alternately disposed upwardly and downwardly across said ball striking face.

5. The putter type golf club head of claim 1 wherein each of said grooves is characterized by a repeating arcuate configuration across said ball striking face.

6. The club head of claim 1 wherein each of said grooves is characterized by a repeating trapezoidal configuration across said ball striking face.

7. The club head of claim 1 wherein each of said grooves is characterized by a repeating chevron configuration across said ball striking face.

8. The club head of claim 1 wherein each of said grooves is characterized by overlapping an adjacent groove.

9. The club head of claim 1 wherein each of said grooves is characterized by a discontinuity along the length of the groove.

10. A putter type golf club head having a frontal ball striking face, top surface, bottom leading edge, heel, toe, rear surface and shaft connection comprising:

a series of individual wavy grooves and land areas separating said grooves extending in a longitudinal direction across said striking face between said toe and said heel; said grooves having a width greater than the width of the land areas between each of said individual grooves; said grooves characterized by a plurality of undulating wave forms in a repeating upwardly and downwardly wave pattern; each wave form of said individual grooves being substantially the same length; said grooves having an upper edge and lower edge; said groove upper edge extending upwardly toward said top surface the same distance as said groove lower edge extends downwardly toward said bottom leading edge; said grooves forming a pattern of repeating waves; said grooves arranged one groove over another between said top surface and said bottom leading edge.

* * * * *